US012215501B2

(12) United States Patent
Gori et al.

(10) Patent No.: US 12,215,501 B2
(45) Date of Patent: Feb. 4, 2025

(54) GUTTER GUARD SYSTEM

(71) Applicant: LeafFilter North, LLC, Hudson, OH (US)

(72) Inventors: Michael Gori, Norton, OH (US); Jason A. Crowell, Akron, OH (US)

(73) Assignee: LeafFilter North, LLC, Hudson, OH (US)

( * ) Notice: Subject to any disclaimer, the term of this patent is extended or adjusted under 35 U.S.C. 154(b) by 0 days.

(21) Appl. No.: 17/933,696

(22) Filed: Sep. 20, 2022

(65) Prior Publication Data

US 2024/0093499 A1 Mar. 21, 2024

(51) Int. Cl.
*E04D 13/076* (2006.01)

(52) U.S. Cl.
CPC ..... *E04D 13/076* (2013.01)

(58) Field of Classification Search
CPC . E04D 13/064; E04D 13/076; E04D 13/0641; E04D 13/0445; E04D 13/0765
See application file for complete search history.

(56) References Cited

U.S. PATENT DOCUMENTS 10,655,334 B2 * 5/2020 Gori ..... E04D 13/076
2006/0123710 A1 * 6/2006 Lenney ..... E04D 13/076 52/12
2011/0067318 A1 * 3/2011 Lenney ..... E04D 13/076 52/12
2013/0276378 A1 * 10/2013 McCoy ..... E04D 13/076 52/12
2013/0284650 A1 * 10/2013 Higginbotham ..... E03F 1/00 210/162
2014/0215929 A1 * 8/2014 Lenney ..... E04D 13/0725 52/12
2015/0040488 A1 * 2/2015 Lenney ..... E04D 13/076 52/12
2020/0308839 A1 * 10/2020 Neeb ..... E04D 13/068

FOREIGN PATENT DOCUMENTS

AU 2010100555 A4 * 7/2010 ..... E04D 13/076

* cited by examiner

*Primary Examiner* — Babajide A Demuren
(74) *Attorney, Agent, or Firm* — Benesch Friedlander Coplan & Aronoff LLP

(57) ABSTRACT

Disclosed herein are gutter guard systems arranged to efficiently manage the flow of rainwater across the system and prevent the matting of debris onto the system. In one exemplary embodiment, a gutter guard system includes a main body and a screen covering the main body. The main body includes a front receiver, a rear receiver, and a water management section positioned between and connecting the front and rear receivers. The screen spans the water management section and is secured to the main body by engagement on one end with the front receiver and on the opposite end with the rear receivers. When the gutter guard system is installed in a rain gutter, the front receiver engages with the front edge of the rain gutter, and the rear receiver engages with the rear portion of the rain gutter.

20 Claims, 12 Drawing Sheets

GUTTER GUARD SYSTEM

FIELD OF INVENTION

The present disclosure generally relates to systems and methods for preventing debris from entering rain gutters while optimizing water flow and infusion into the rain gutter. More specifically, the present disclosure relates to a gutter guard system comprising an assembly of a main body and a screen, where the main body includes a front receiver and rear receiver integrated with a water management section.

BACKGROUND

Rain gutter systems are commonly used for residential homes, building, and other structures to manage rainwater by collecting the rainwater and channeling that rainwater away from the structure. Such management of rainwater can be critical for the overall maintenance and condition of the structure by reducing or eliminating damage to the structure and its foundation that can be caused by uncontrolled rainwater. Gutter guards are components or systems that are typically attached to or incorporated into rain gutters to prevent leaves, pine needles, branches, soot, and other such debris from entering the rain gutter. Such debris can clog the rain gutter and reduce its effectiveness in channeling rainwater away from a residential home, building, or other structure. In addition, such debris can damage and shorten the service life of a rain gutter system by causing corrosion, pitting, or other deleterious effects on the rain gutter system. Unfortunately, prior art gutter guard systems do not effectively channel water away from a structure. Inefficient water management designs and matting of debris onto the gutter guard system over time, which reduces property values, increases maintenance costs, and causes dangerous conditions for occupants of structures.

There is a need for improvement over existing gutter guards, systems, and/or methods for gutter guard protection that provides more efficient management and channeling of rainwater and resists the matting of debris on the gutter guard. This disclosure provides such improved gutter guard systems.

SUMMARY

Disclosed herein are gutter guard systems arranged to efficiently manage the flow of rainwater across the system and prevent the matting of debris onto the system. In one exemplary embodiment, a gutter guard system includes a main body and a screen covering the main body. The main body includes a front receiver, a rear receiver, and a water management section positioned between and connecting the front receiver and rear receivers. The screen spans the water management section and is secured to the main body by engagement on one end with the front receiver and on the opposite end with the rear receivers. When the gutter guard system is installed in a rain gutter, the front receiver engages with the front edge of the rain gutter, and the rear receiver engages with the rear portion of the rain gutter.

The screen is arranged to promote the flow of rainwater across the screen and downward through the screen toward the water management section of the main body. The screen can include certain features that affect the speed and path of rainwater flowing across the screen. In one embodiment, the screen includes a raised section running along the length of the screen. The raised section can be generally rounded and semi-circular in cross-section. The raised section slows the rainwater as it flows across the raised area of the screen and provides a greater opportunity for the rainwater to pass through the screen toward the water management section. In another embodiment, a section of screen located proximate to the front receiver is angled upward. In this embodiment, an adapter is used to secure the end of the screen to the front receiver. This upwardly angled section causes rainwater flowing across the screen to slow and provide additional time for the rainwater to pass through the screen toward the water management section.

The water management section of the main body includes a series of channels with a plurality of slots formed in each channel to promote the flow of rainwater through the water management section and into the rain gutter. The water management section can be arranged with a varying number and styles of channels. Certain embodiments include shallow channels with generally straight sides and a flat bottom with a plurality of slots formed in the flat bottoms of the channels. In other embodiments, the water management section includes deep channels with angled walls and rounded bottoms with a plurality of slots formed in the channels to span the angled side walls and the rounded bottoms. Water management sections can include a combination of both shallow and deep channels. Such a combination of shallow channels with slots in the flat bottoms of the channels and deep channels with slots that span the angled walls and the rounded bottoms of channels promotes air flow in both the horizontal and vertical directions, which is effective and efficient in managing the removal of matted debris on the screen of the gutter guard system.

BRIEF DESCRIPTION OF THE DRAWINGS

In the accompanying drawings, structures are illustrated that, together with the detailed description provided below, describe example embodiments of the disclosed systems, methods, and apparatus. Where appropriate, like elements are identified with the same or similar reference numerals. Elements shown as a single component can be replaced with multiple components. Elements shown as multiple components can be replaced with a single component. The drawings may not be to scale. The proportion of certain elements may be exaggerated for the purpose of illustration.

DETAILED DESCRIPTION

Figure 1:
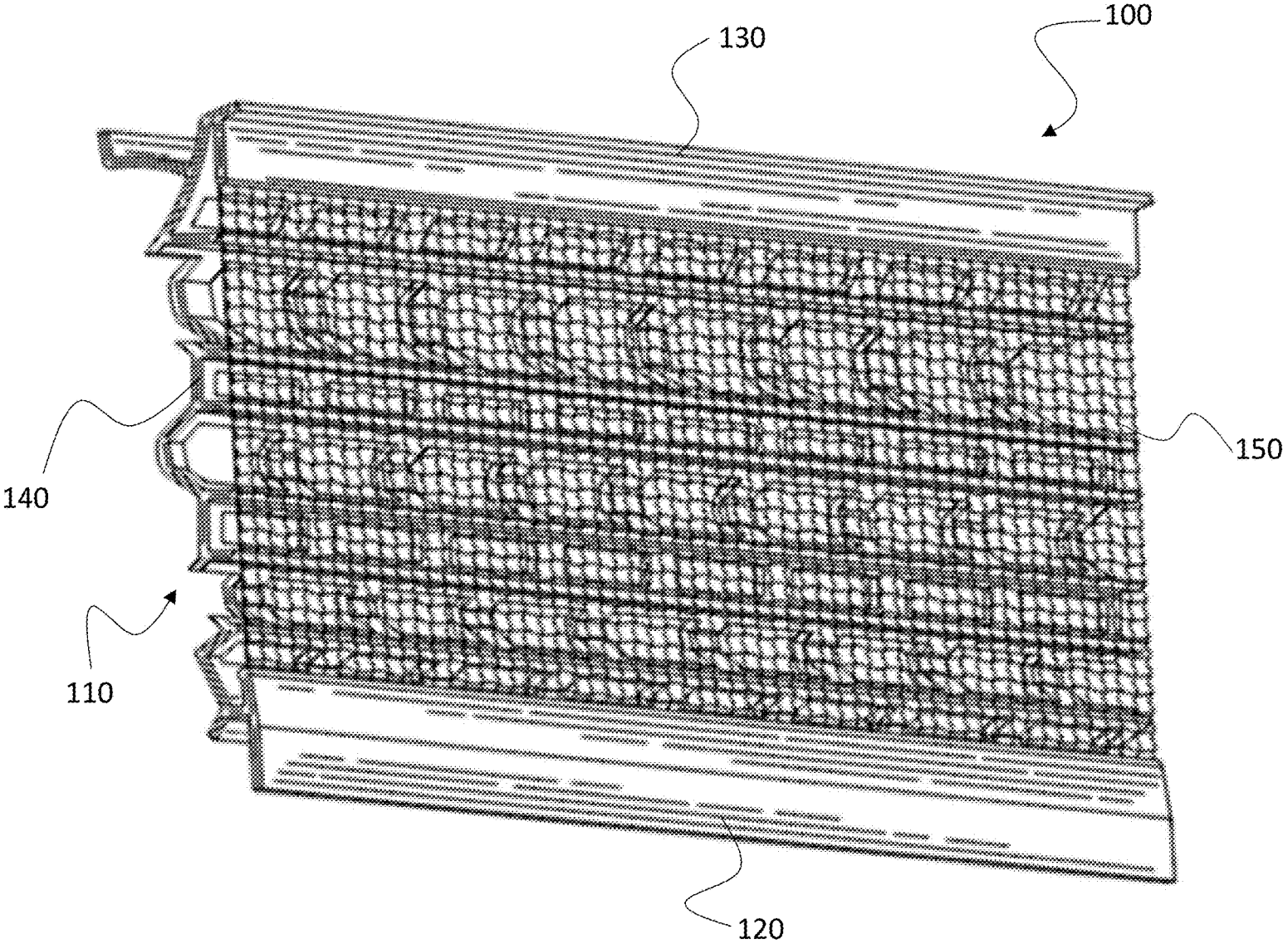
FIG. 1 schematically illustrates a perspective view of a first embodiment of a gutter guard system.

The apparatus, systems, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, method, etc. are either related to a specific example presented or are merely a general description of such a technique, arrangement, method, etc. Identifications of specific details or examples are not intended to be and should not be construed as mandatory or limiting unless specifically designated as such. Selected examples of gutter guard systems are hereinafter disclosed and described in detail with reference made to FIGS. 1-10.

As will be described in detail herein, an exemplary embodiment of a novel gutter guard system includes two major components: (i) a main body with an integrated front receiver, rear receiver, with a water management section extending between and connecting the front receiver and rear receiver and (ii) a screen that is positioned over the water management section and secured to the main body by engagement with the front receiver and rear receiver. The gutter guard system is arranged to be positioned proximate to the top opening of a rain gutter installed on a home or other structure. Typically the gutter guard system generally spans the top opening of the rain gutter. As will be described herein, the screen and water management section include a number of features that assist in managing the flow of rainwater across the gutter guard system to provide for efficient and effective flow of rainwater across the screen and down toward the water management section and subsequently through the water management section and into the rain gutter. The screen is arranged to discourage the matting of debris on the top side of the screen through the screen's construction, positioning, and design features. The main body is arranged to promote airflow in and around the water management section in both in the vertical and horizontal directions. Such flow of air in multiple directions effectively discourages debris from resting on and subsequently matting on the top side of the screen.

The gutter guard system can be manufactured in a plurality of sizes to accommodate various sizes of rain gutters. For example, as will be described and illustrated herein, the gutter guard system can be manufactured to accommodate a five-inch rain gutter or a six-inch rain gutter. The gutter guard system can be manufactured to accommodate various styles of rain gutters. In particular, the structure of the front receiver and rear receiver relative to the main body can be arranged to accommodate a number of different style of rain gutters, such as K-style, half-round, fascia style, and even custom designed rain gutters. The examples described and illustrated herein are directed to a gutter guard system designed and manufactured to accommodate five-inch and six-inch K-style rain gutters. However, it will be understood that such examples are non-limiting. As will be further explained herein, coatings and/or films of various colors can be applied to the front receivers and/or rear receivers to enhance the aesthetic appeal and weather resistance of the front and rear receivers.

The main body can be manufactured from a number of materials, including metal and polymeric material such as polyvinyl chloride (PVC), polyethylene (PE), polyolefin (PO), or any other relatively rigid polymer. The main body can be manufactured using a variety of methods including extrusion, injection molding, additive manufacturing (i.e., 3D printing), machining, metal casting, metal stamping, punching, and the like. In some embodiments, more than one manufacturing process can be used. For example, a main body can be machined, stamped, punched, or otherwise modified, after it is formed via extrusion or injection molding. In one embodiment, the main body is manufactured from a polymeric material using an extrusion process. Slots in the channels of the water management section are formed by a punching process. The punching process can be performed in-line with the extrusion process or can be an off-line process that punches the holes after the extrusion process is complete. The examples of gutter guard systems described and illustrated herein are not limiting or exhaustive, and one of ordinary skill in the art will readily understand that components of the gutter guard system can be manufactured in any number of ways.

In one embodiment, the screen is a 30 mesh metal screen. In one example, the screen can be made of 316L stainless steel wire, more specifically, 316L stainless steel wire that is 0.0085 inches in diameter. The screen can be arranged in a square weave such that there are 30 wires for each linear inch of screen in both the width and length directions. In such an arrangement, the surface area of the screen includes approximately 55% open area. It will be understood with such a large percentage of open area, the screen can facilitate water flowing through the screen toward the water management section and into the rain gutter even when debris such as leaves temporarily come to rest on top of the screen. The 0.0085 inch diameter 316L stainless steel wire arranged as such provides a number of benefits, including resistance to corrosion and rust when exposed to the elements, generally prevents common debris from passing through the screen, facilitates self-cleaning of the screen due to debris passing over the screen, and promotes water infusion through the screen as water travels across the screen. Furthermore, in one embodiment, such an arrangement maintains a generally flat surface when exposed to the elements so that the screen maintains its functionality and aesthetic appeal over time. In other embodiments, as will be described herein, the screen includes features and contours that rise above the general plane of the screen to promote rainwater infusion through the screen and to prevent or limit the matting of debris on the top of the screen.

Figure 2:
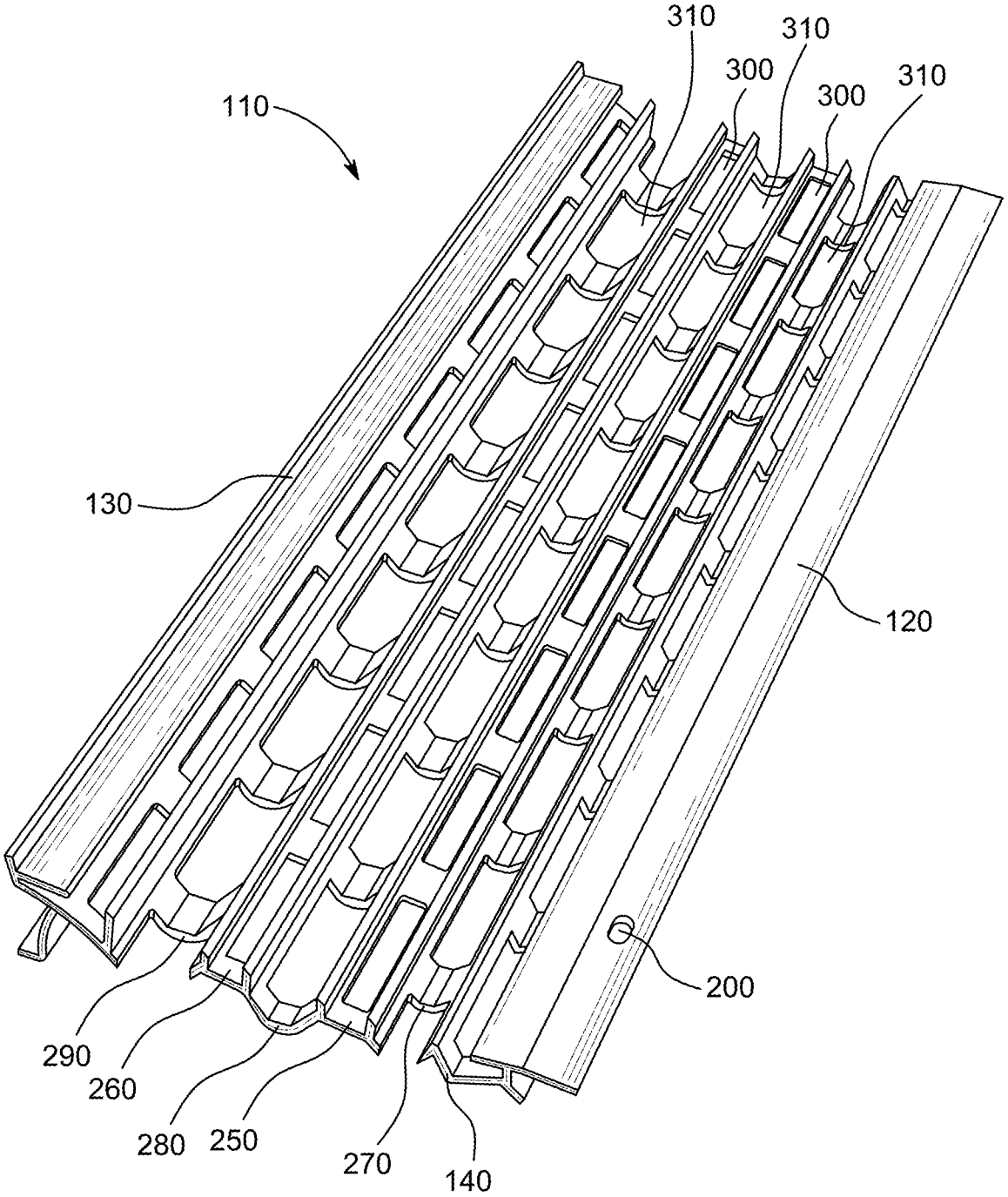
FIG. 2 schematically illustrates a perspective view of a main body for use with the first embodiment of the gutter guard system.
Figure 3:
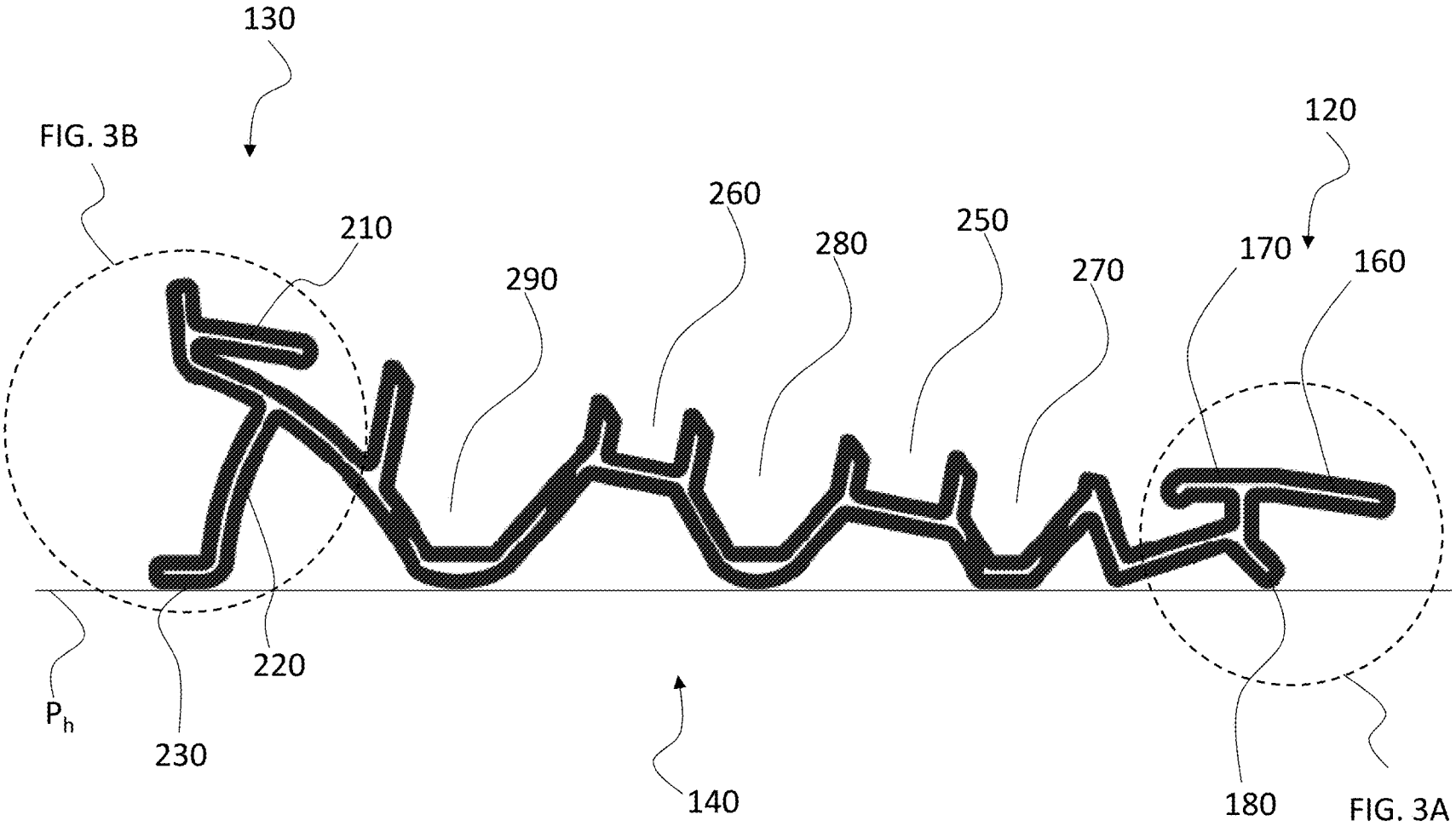
FIG. 3 schematically illustrates a side elevation view of a main body for use with the first embodiment of the gutter guard system.

FIGS. 1-4 schematically illustrate a first embodiment of a gutter guard system 100 for use with a five-inch K-style rain gutter. The gutter guard system 100 includes a main body 110 with a front receiver 120, a rear receiver 130, and a water management section 140 positioned between and connecting the front receiver 120 and rear receiver 130. The front receiver 120, the rear receiver 130, and the water management section 140 are integrally formed into a continuous main body 110. The gutter guard system 100 further includes a screen 150 spanning the water management section 140 and secured to the main body 110 by interior extending portions of the front receiver 120 and rear 130 receiver. As illustrated in FIG. 3, a side view of the main body 110, the front receiver 120, rear receiver 130, and water management section 140 include multiple features that will be subsequently described in detail.

Figure 3A:
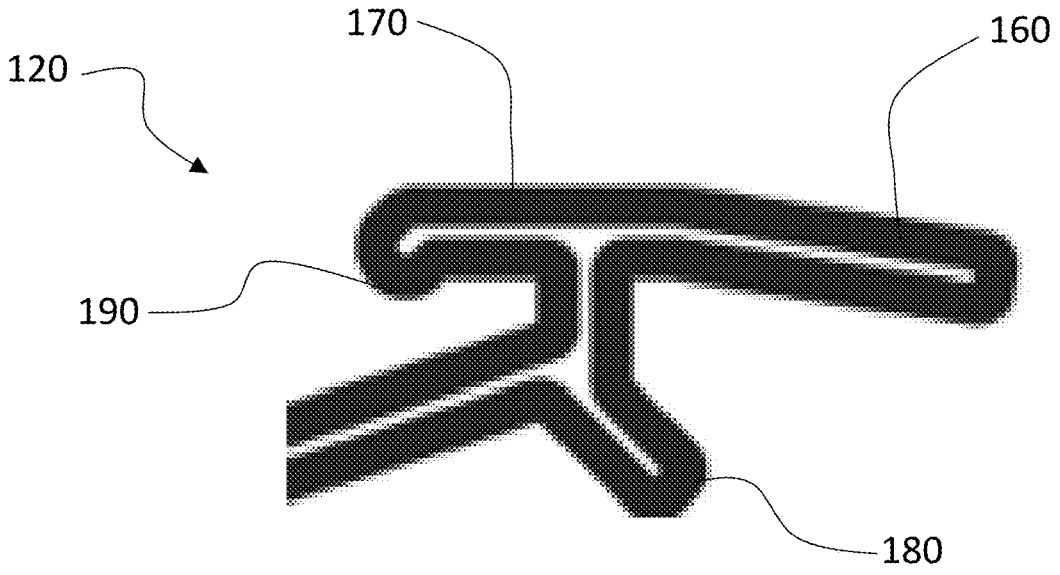
FIG. 3A is a detailed view of the front receiver as identified by the section of FIG. 3 marked as FIG. 3A.
Figure 3B:
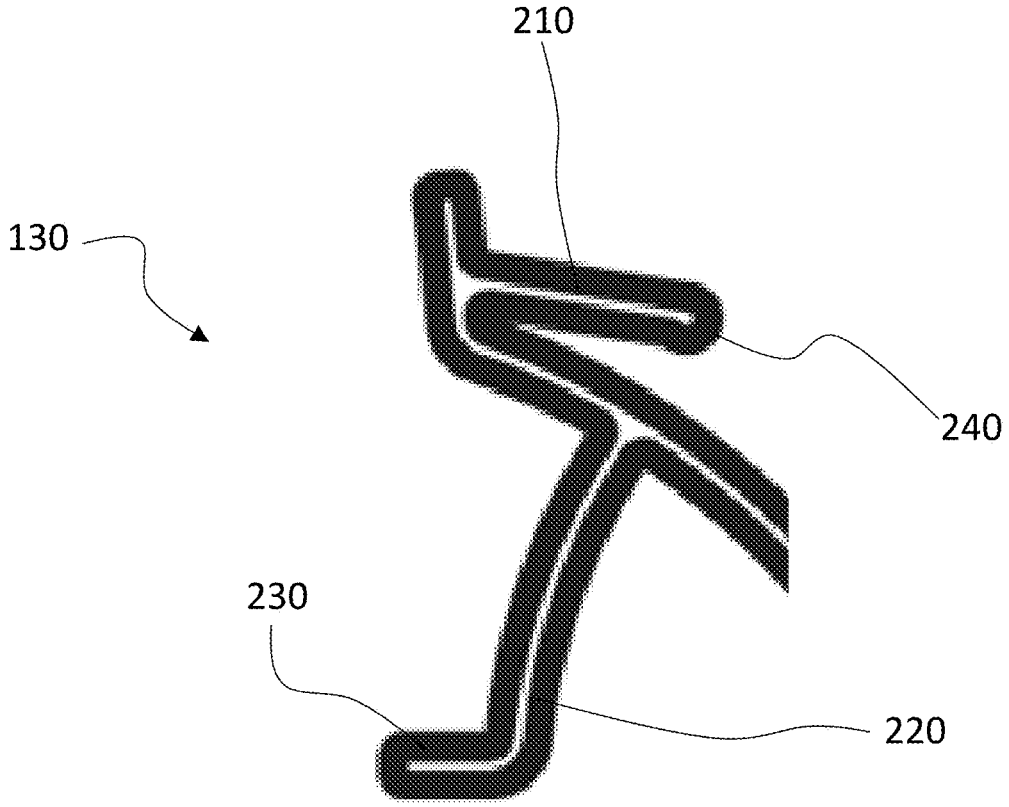
FIG. 3B is a detailed view of the rear receiver as identified by the section of FIG. 3 marked as FIG. 3B.
Figure 4:
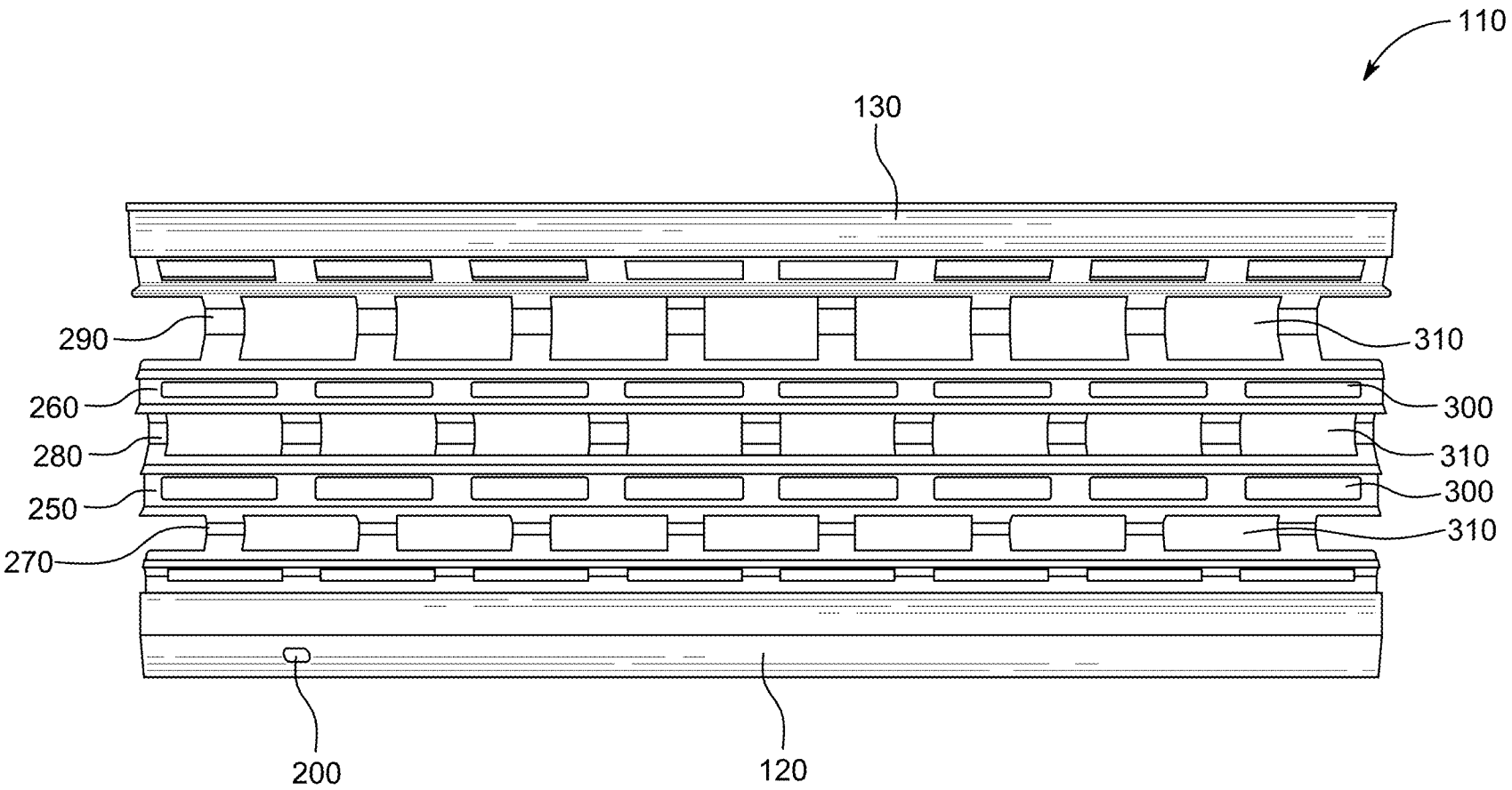
FIG. 4 schematically illustrates a top plan view of a main body for use with the first embodiment of the gutter guard system.
Figure 5:
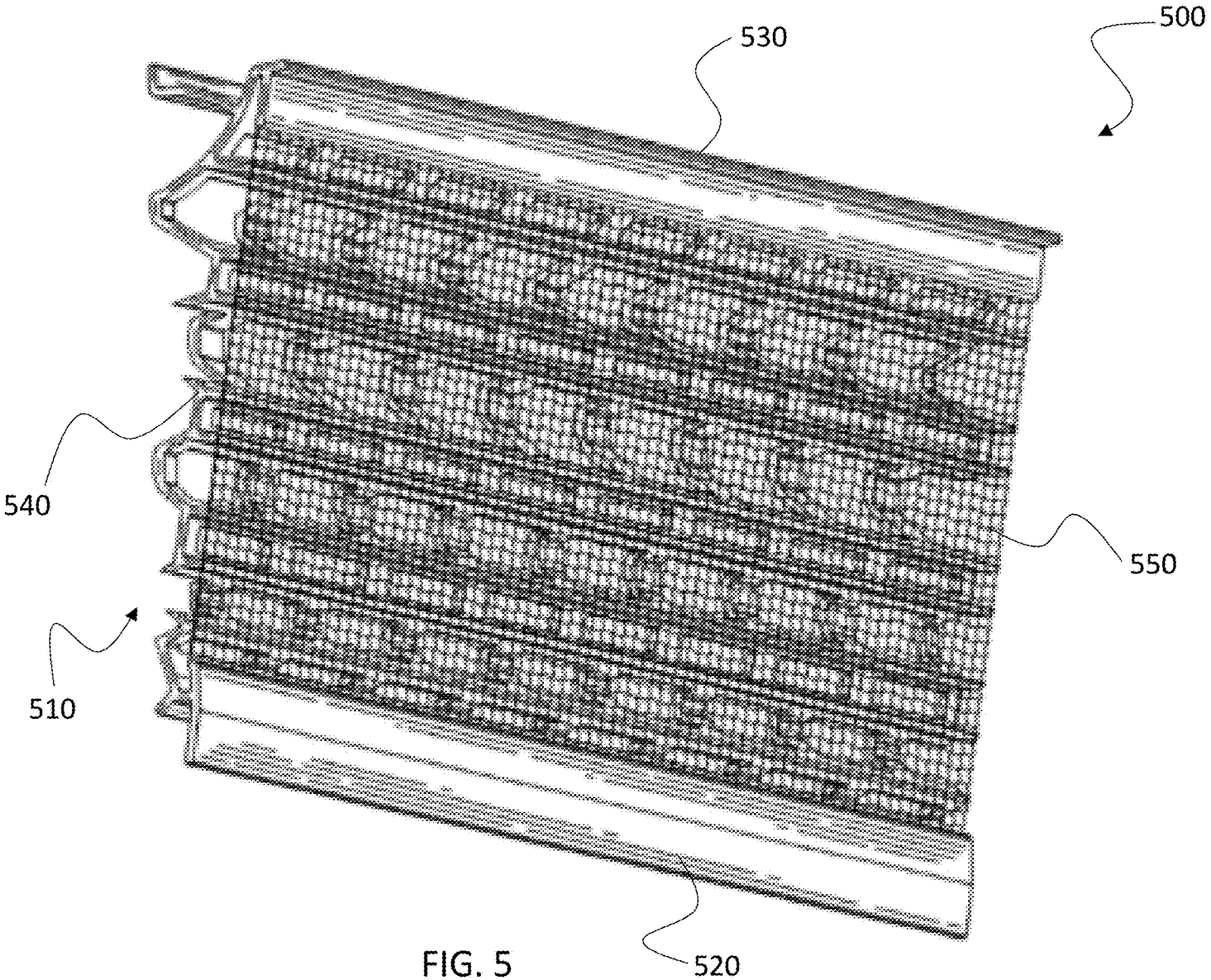
FIG. 5 schematically illustrates a perspective view of a second embodiment of a gutter guard system.

As illustrated in FIGS. 3 and 3A, the front receiver 120 includes an outward extending edge 160, an inward extending edge 170, and a forward angled leg 180. Furthermore, the end of the inwardly extending edge 170 includes a downward rounded feature 190. When the gutter guard system 100 is installed in a rain gutter, typically a hanger system is used to support the gutter guard system 100 proximate to the top of the rain gutter. The front receiver 120 can be positioned to engage with the front edge of the rain gutter. For example, once installed, the outward extending edge 160 of the front receiver 120 can be positioned over the top of and in contact with the front edge of the rain gutter. Furthermore, the forward angled leg 180 can engage with an interior wall of the front of the rain gutter to stabilize the location of the gutter guard system 100 relative to the rain gutter. As illustrated in FIGS. 2 and 4, an aperture 200 is provided in the front receiver 120 that can be used to further secure the front receiver 120 to the rain gutter using a fastener such as a screw or rivet. It will be understood that multiple apertures can be formed in the front receiver 120 to provide multiple locations to fasten the front receiver 120 (and thus, secure the gutter guard system 100) to the distal edge of the rain gutter.

The rear receiver 130 includes an inward extending edge 210 and a rearward angled leg 220. The rearward angled leg 220 includes a foot 230 extending rearward from the end of the rearward angled leg 220. The end of the inward extending edge 210 includes a downward rounded feature 240. The foot 230 and rearward angled leg 220 of the rear receiver 130 are arranged to provide for flexibility in the installation of the gutter guard system 100 in a rain gutter. For example, in some arrangements, the foot 230 can be in contact with a hanger or other support structure installed with or on the rain gutter. In other embodiments, the foot 230 can be in contact with the side of the house or structure or can be positioned in contact with a rear portion of the rain gutter. In other embodiments, a hanger system can be installed such that the foot 230 is not in contact with either the house or rain gutter.

When the screen 150 is installed onto the main body 110, one edge of the screen 150 is positioned under the inward extending edge 170 of the front receiver 120, and the opposite edge of the screen 150 is positioned under the inward extending edge 210 of the rear receiver 130. The edges of the screen 150 are slightly deformed by their engagement with the downward rounded feature 190 of the front receiver 120 and the downward rounded feature 240 of the rear receiver 130. Such slight deformation creates a friction fit that secures the screen 150 in place relative to the main body 110. Additionally, an adhesive or other similar substance can be used to secure the screen 150 to the main body 110.

The water management section 140 includes a number of features to manage the flow of water across the gutter guard system 100. In the first embodiment illustrated in FIGS. 1-4, the water management section 140 includes a total of five channels, including a pair of shallow channels 250, 260 and three deep channels 270, 280, 290. The pair of shallow channels 250, 260 extend the length of the main body 110 and include generally straight vertical walls and a flat bottom. In the illustrated embodiment, the two shallow channels 250, 260 are generally similar in dimensions. As best illustrated in FIG. 4, the pair of shallow channels 250, 260 include a series of slots 300 extending along the flat bottom of the pair of shallow channels 250, 260. The slots 300 are generally rectangular in shape and elongated in the lateral direction of the channel 250, 260. The three deep channels 270, 280, 290 extend the length of the main body 110 and include angled walls and a rounded interior bottom to form a generally U-shaped channel. The deep channels 270, 280, 290 include slots 310 that run along the angled walls and rounded bottom of the deep channels 270, 280, 290 to form relatively large openings in the deep channels 270, 280, 290. As best illustrated in FIG. 3, the three deep channels 270, 280, 290 differ in dimension from each other. Deep channel 290, which is located proximate to the rear receiver 130, is the largest of the three deep channels 270, 280, 290, having the greatest width and depth. Deep channel 270, which is located proximate to the front receiver 120, is the smallest of the three deep channels 270, 280, 290, having the smallest width and depth. Deep channel 280, which is located between the other two deep channels 270, 290 and has a depth and width that is between that of the other two deep channels 270, 290.

The deep channels 270, 280, 290 are designed to be progressively larger from the front receiver 120 to the rear receiver 130 to accomplish two goals. First, when rainwater is channeled from the roof of a home or structure onto the gutter guard system 100, the largest volume of rainwater is experienced proximate to the home or structure. Thus, the deep channel 290 located proximate to the rear receiver 130 is designed to be large enough to accommodate a large volume of rainwater passing though the deep channel 290. The volume of rainwater is reduced as the rainwater moves across the gutter guard system 100 toward the front receiver 120. Therefore, deep channels 270, 280 are proportionally sized to accommodate the reduced volume of rainwater. Secondly, the varying depths of the deep channels 270, 280, 290 result in the bottoms of the deep channels 270, 280, 290 effectively engaging with a horizontal component of a hanger system used to support the installed gutter guard system 100. Because the gutter guard system 100 is installed so that the screen 150 generally slopes downward from the rear receiver 130 to the front receiver 120, the progressively varying depth of the forward-most deep channel 270 to the rear-most deep channel 290 results in all the bottom surfaces of the deep channels 270, 280, 290 positioned on a common horizontal plane (as illustrated by line Ph in FIG. 3). Thus, the bottom surfaces of the deep channels 270, 280, 290 can all engage and be supported by a horizontal component of a hanger system.

Figure 6:
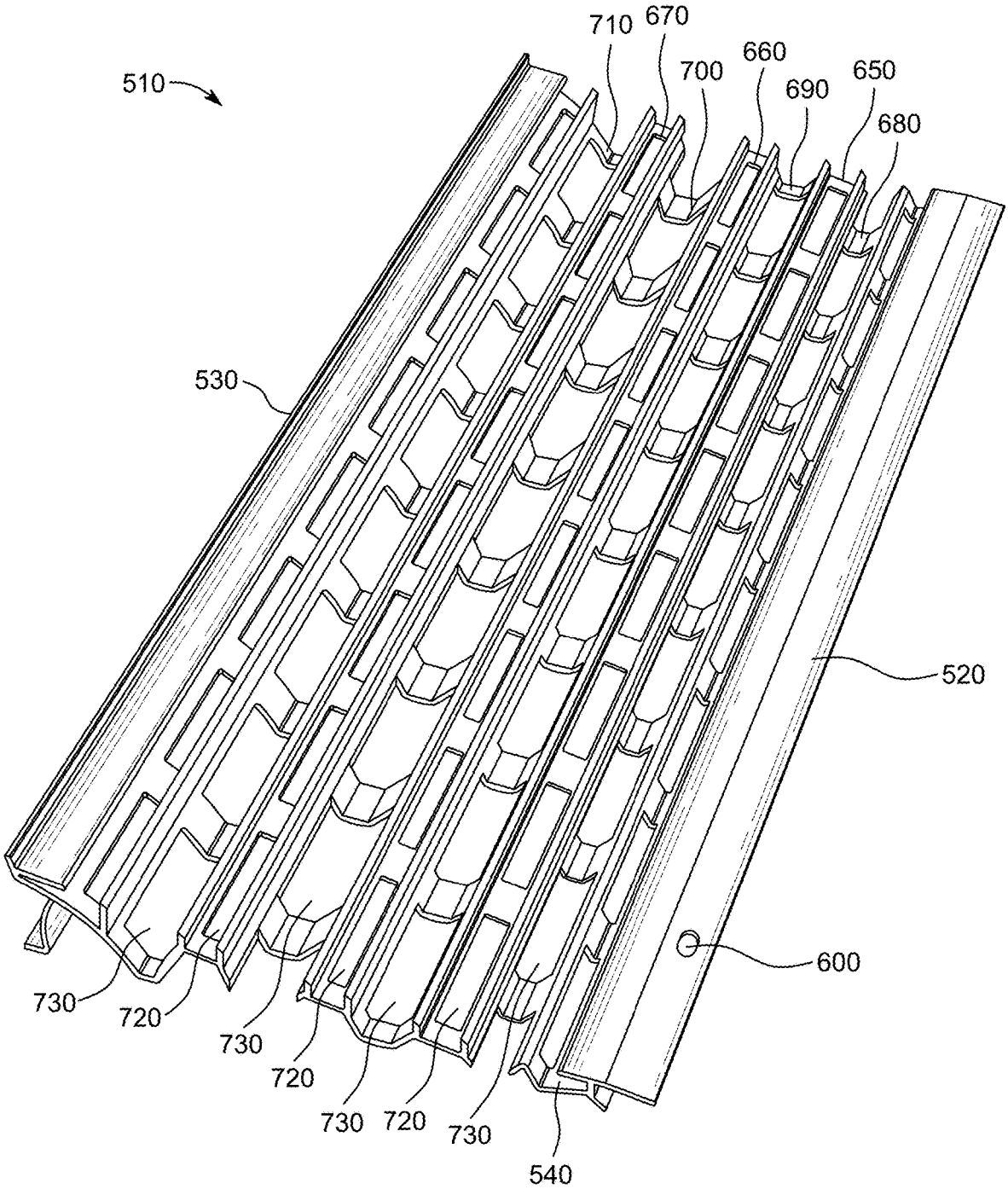
FIG. 6 schematically illustrates a perspective view of a main body for use with the second embodiment of the gutter guard system.
Figure 7:
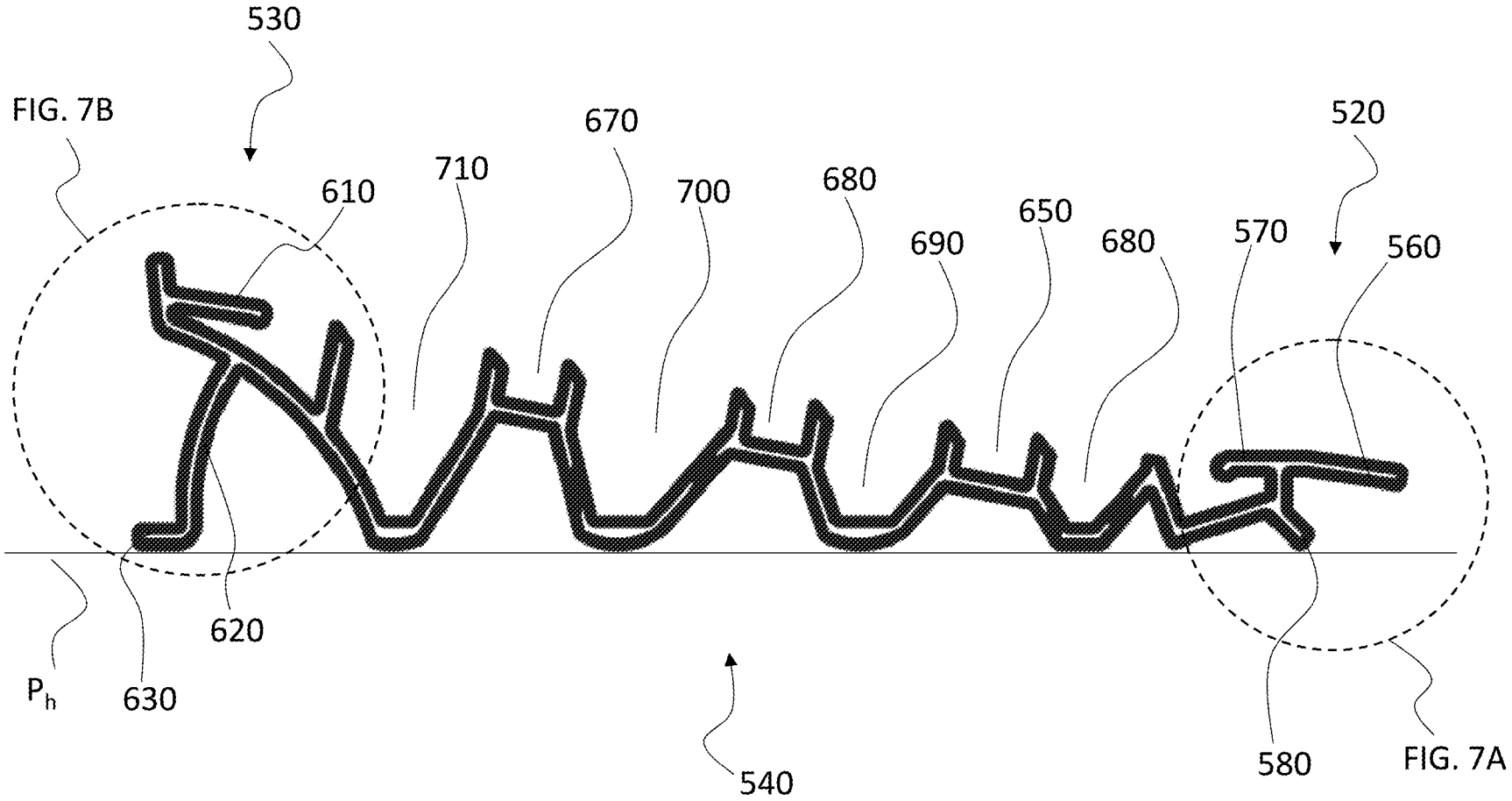
FIG. 7 schematically illustrates a side elevation view of a main body for use with the second embodiment of the gutter guard system.

FIGS. 5-8 schematically illustrate a second embodiment of a gutter guard system 500 for use with a six-inch K-style rain gutter, which shares many structural and functional features with the first embodiment of the gutter guard system 100 illustrated in FIGS. 1-4. The gutter guard system 500 includes a main body 510 with a front receiver 520, a rear receiver 530, and a water management section 540 positioned between and connecting the front receiver 520 and the rear receiver 530. The gutter guard system 500 further includes a screen 550 spanning the water management section 540 and secured to the main body 510 by interior portions of the front 520 and rear 530 receivers. As illustrated in FIG. 7, a side view of the main body 510, the front receiver 520, rear receiver 530, and water management section 540 include multiple features that will be subsequently described in detail.

Figure 7A:
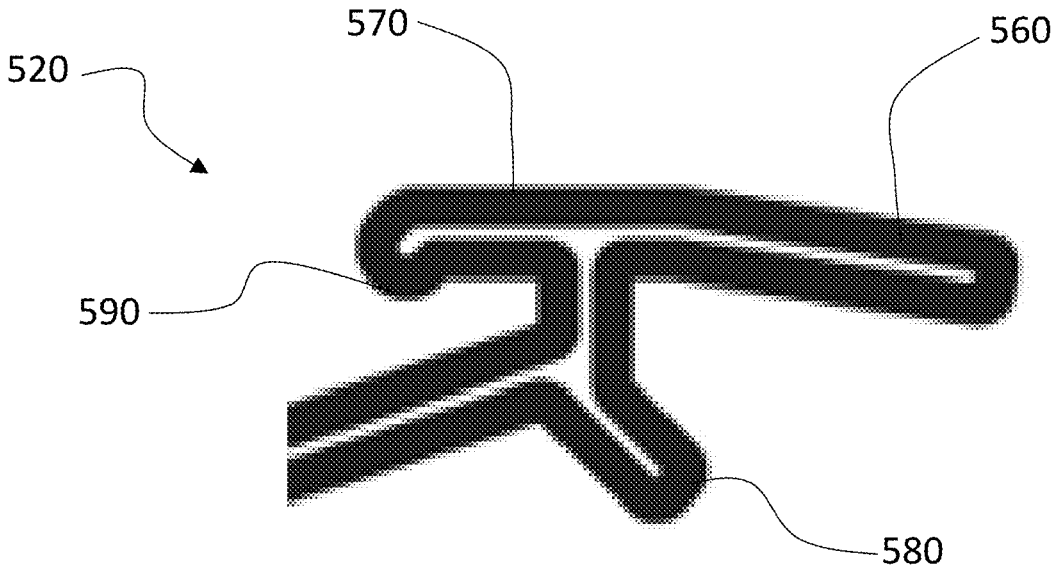
FIG. 7A is a detailed view of the front receiver as identified by the section of FIG. 7 marked as FIG. 7A.
Figure 8:
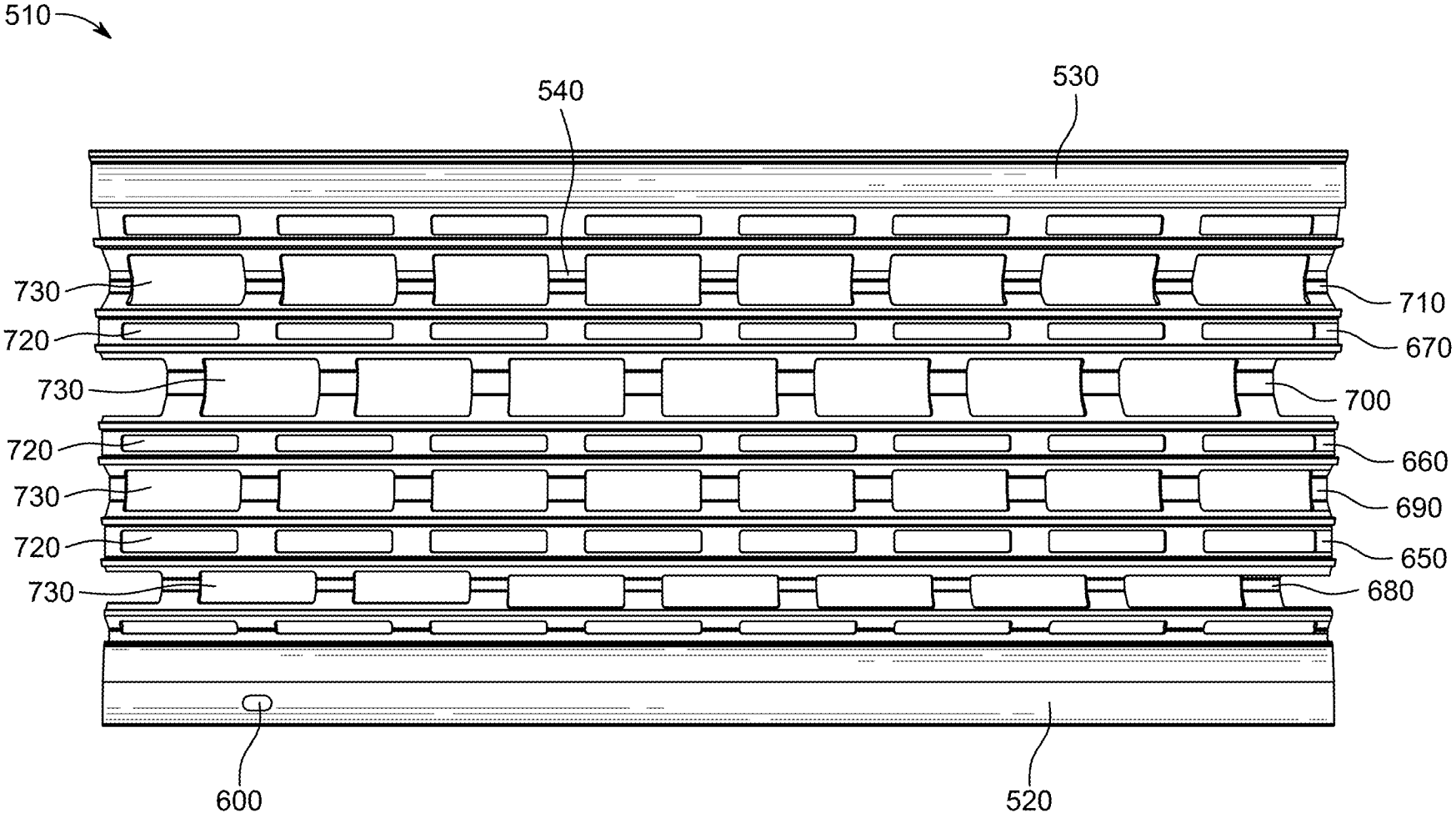
FIG. 8 schematically illustrates a top plan view of a main body for use with the second embodiment of the gutter guard system.

As illustrated in FIGS. 7 and 7A, the front receiver 520 includes an outward extending edge 560, an inward extending edge 570, and a forward angled leg 580. Furthermore, the end of the inwardly extending edge 570 includes a downward rounded feature 590. When the gutter guard system 500 is installed in a rain gutter, typically a hanger system is used to support the gutter guard system 500 proximate to the top of the rain gutter. The front receiver 520 can be positioned to engage with the front edge of the rain gutter. For example, once installed, the outward extending edge 560 of the front receiver 120 can be positioned over the top of and in contact with the front edge of the rain gutter. Furthermore, the forward angled leg 580 can engage with an interior wall of the front of the rain gutter to stabilize the location of the gutter guard system 500 relative to the rain gutter. As illustrated in FIGS. 6 and 8, an aperture 600 is provided in the front receiver 520 that can be used to further secure the front receiver 520 to the rain gutter using a fastener such as a screw or rivet. It will be understood that multiple apertures can be formed in the front receiver 520 to provide multiple locations to fasten the front receiver 520 (and thus, secure the gutter guard system 500) to the distal edge of the rain gutter.

Figure 7B:
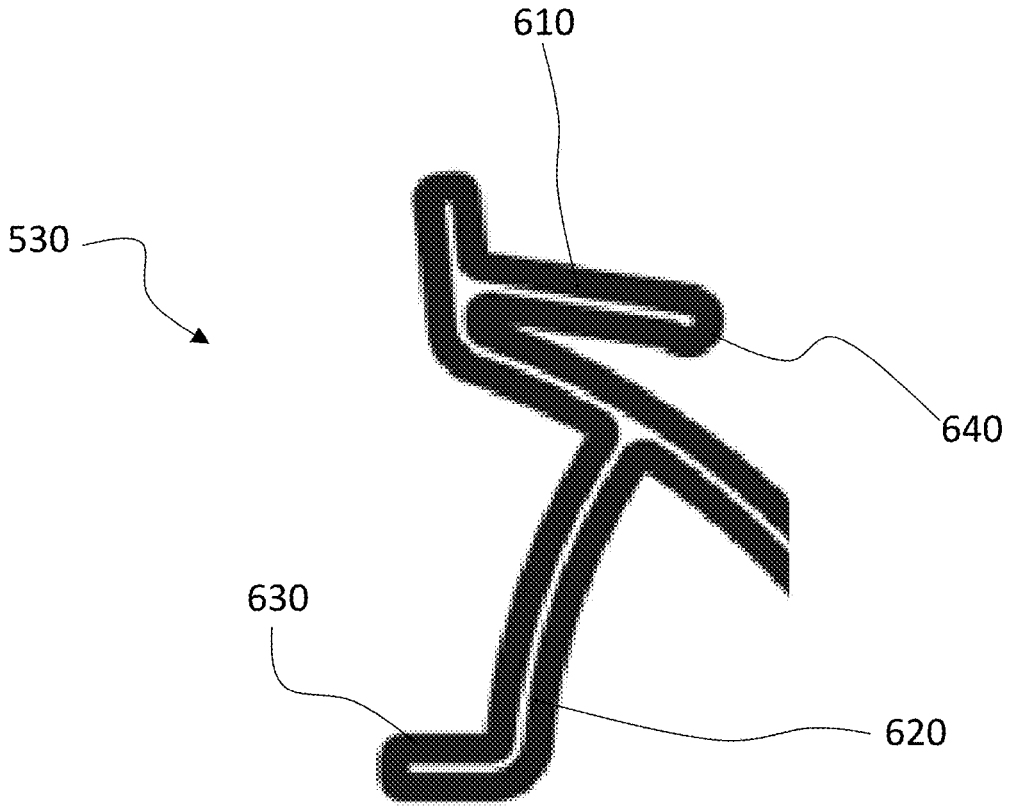
FIG. 7B is a detailed view of the rear receiver as identified by the section of FIG. 7 marked as FIG. 7B.

As illustrated in FIGS. 7 and 7B, the rear receiver 530 includes an inward extending edge 610 and a rearward angled leg 620. The rearward angled leg 620 includes a foot 630 extending rearward from the end of the rearward angled leg 620, and the end of the inward extending edge 610 includes a downward rounded feature 640. The foot 630 and rearward angled leg 620 of the rear receiver 530 are arranged to provide for flexibility in the installation of the gutter guard system 500 in a rain gutter. For example, in some arrangements, the foot 630 can be in contact with the side of the house or structure or can be positioned in contact with a rear portion of the rain gutter. In other embodiments, a hanger system can be installed such that the foot 630 is not in contact with either the house or rain gutter.

As in the first embodiment of the gutter guard system 100, when the screen 550 is installed onto the main body 510 of the second gutter guard system 500, one edge of the screen 550 is positioned under the inward extending edge 570 of the front receiver 520, and the opposite edge of the screen 550 is positioned under the inward extending edge 610 of the rear receiver 530. The edges of the screen 550 are slightly deformed by the downward rounded feature 590 of the front receiver 520 and the downward rounded feature 640 of the rear receiver 530. Such slight deformation creates a friction fit that secures the screen 550 in place relative to the main body 510. Additionally, an adhesive or other similar substance can be used to secure the screen 550 to the main body 510.

The water management section 540 includes a number of features to manage the flow of water across the gutter guard system 500 but differs from the first embodiment of gutter guard system 100. In the second embodiment illustrated in FIGS. 5-8, the water management section 540 includes three shallow channels 650, 660, 670 and four deep channels 680, 690, 700, 710. The shallow channels 650, 660, 670 extend the length of the main body 510 and include generally straight vertical walls and a flat bottom. The dimensions of the shallow channels 650, 660, 670 are all generally similar. As best illustrated in FIG. 8, the shallow channels 650, 660, 670 include a series of slots 720 extending along the flat bottom of the shallow channels 650, 660, 670. The deep channels 680, 690, 700, 710 extend the length of the main body 510 and include angled walls and a rounded bottom to form a U-shaped channel. The deep channels 680, 690, 700, 710 also include slots 730 that run along the angled walls and rounded bottom of the deep channels 680, 690, 700, 710. Similar to the embodiment illustrated in FIGS. 1-4, the size and dimensions of the deep channels 680, 690, 700, 710 increase progressively from the forward-most deep channel 680 to the rear-most deep channel 710 and generally provide the same benefits as described with the embodiment illustrated in FIGS. 1-4.

The mixture of shallow channels and deep channels, the structure of those channels, and the size and positioning of the slots provide for a gutter guard system with superior management of water flow and air flow to provide for an efficient system that manages large amounts or rainwater and prevents matting of debris on the surface of the screen. The slots 310, 730 of the deep channels are relatively large and run along both the bottom of the deep channels and side walls of the deep channels. This provides for significant open area in the main body to capture a significant amount of water and promote the free flow of air through the main body. The slots extending to the side walls of the deep channels promotes airflow in a horizontal direction in addition to the vertical direction. This free flow of air assists in the management of debris that settles on the surface of the screen. Foremost, this free flow of air creates currents that can dislodge debris from the screen. Secondly, this free flow of air encourages evaporation of moist debris that is matted on the screen so that, once dry, currents can more easily dislodge debris.

Additional features include tapered edges at the tops of the shallow and deep channels. Such tapered edges are in contact with the underside of the screen and function as wicking edges. As water flows across the screen, the contact points created by the tapered edges create a wicking phenomena that cause water flowing across the screen to change direction at the point of contact between the tapered edges and the screen and flow downward through the screen and along the walls of the channels. Once in the channels, the water freely flows through the slots and into the rain gutter.

Additional features of the gutter guard system include: (i) curved bottoms of the deep channels provide for stiffness and general structural integrity of the main body; (ii) the slots of the channels are staggered (as best illustrated in FIGS. 4 and 8), which provides for openings to accommodate hangers and ensure that at least some portion of the main body engages with and is supported by the hanger system; and (iii) the arrangements described and illustrated herein provide for a wider screen than many prior art gutter guard systems, which provides for more time and opportunity for rainwater passing across the screen to be directed downward into the rain gutter.

Figure 9:
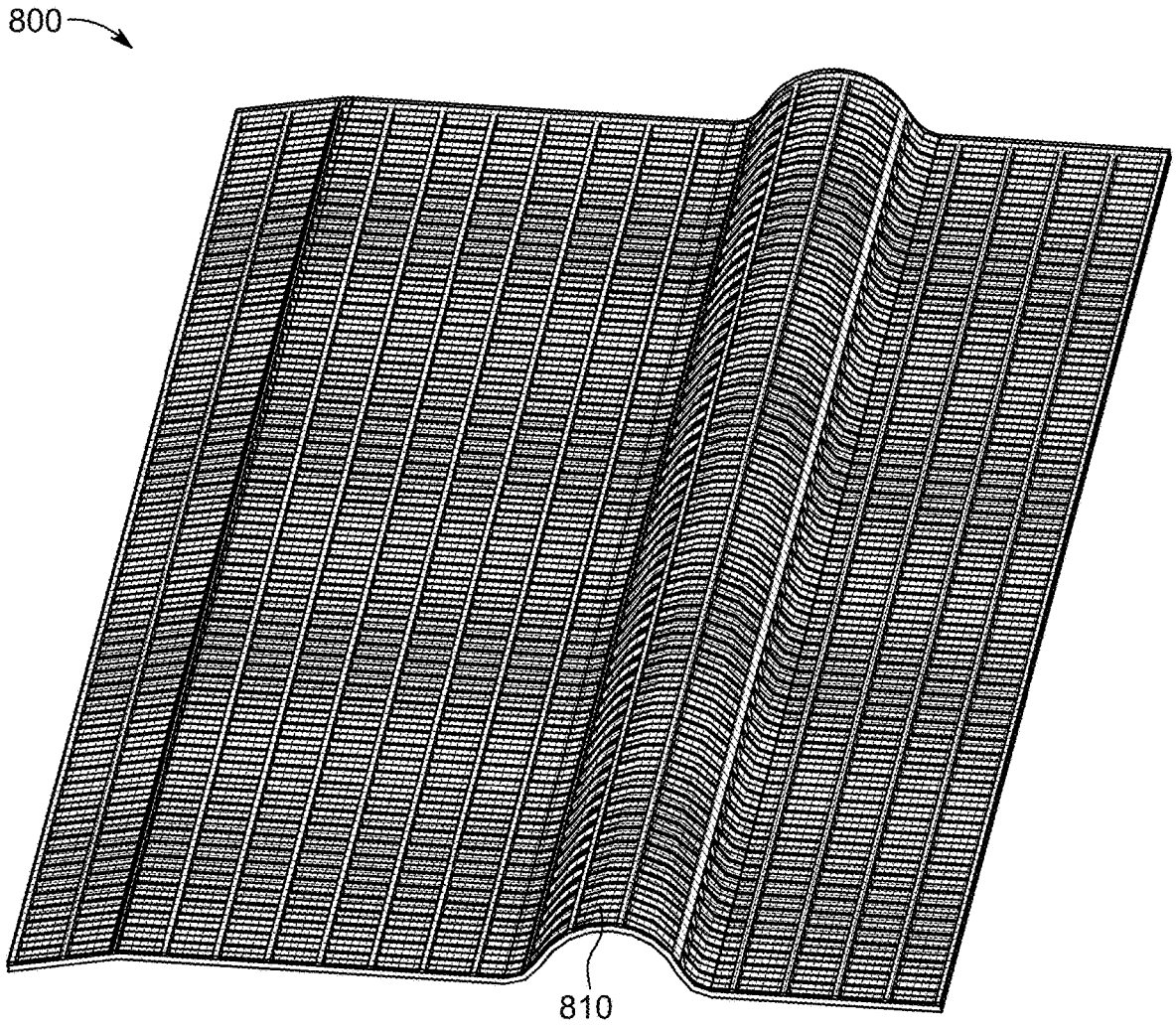
FIG. 9 schematically illustrates a screen for use with a gutter guard system.

In addition to the screen 150, 550 illustrated in FIGS. 1-8, other alternative designs for screens can be used with the gutter guard systems disclosed herein. For example, FIG. 9 illustrates a screen 800 that includes a raised and rounded area 810 running along the length of the screen 800. The raised and rounded area 810 serves as a hurdle or obstacle that slows down rainwater as it passes over the screen 800. This slowing of rainwater keeps the rainwater on the surface of the screen for a longer period of time, providing more opportunity for the water to wick downward, pass through the screen and into the rain gutter. The raised area additionally promotes air flow across the surface of the screen 800 and results in less matting of debris on the top surface of the screen 800.

Figure 10:
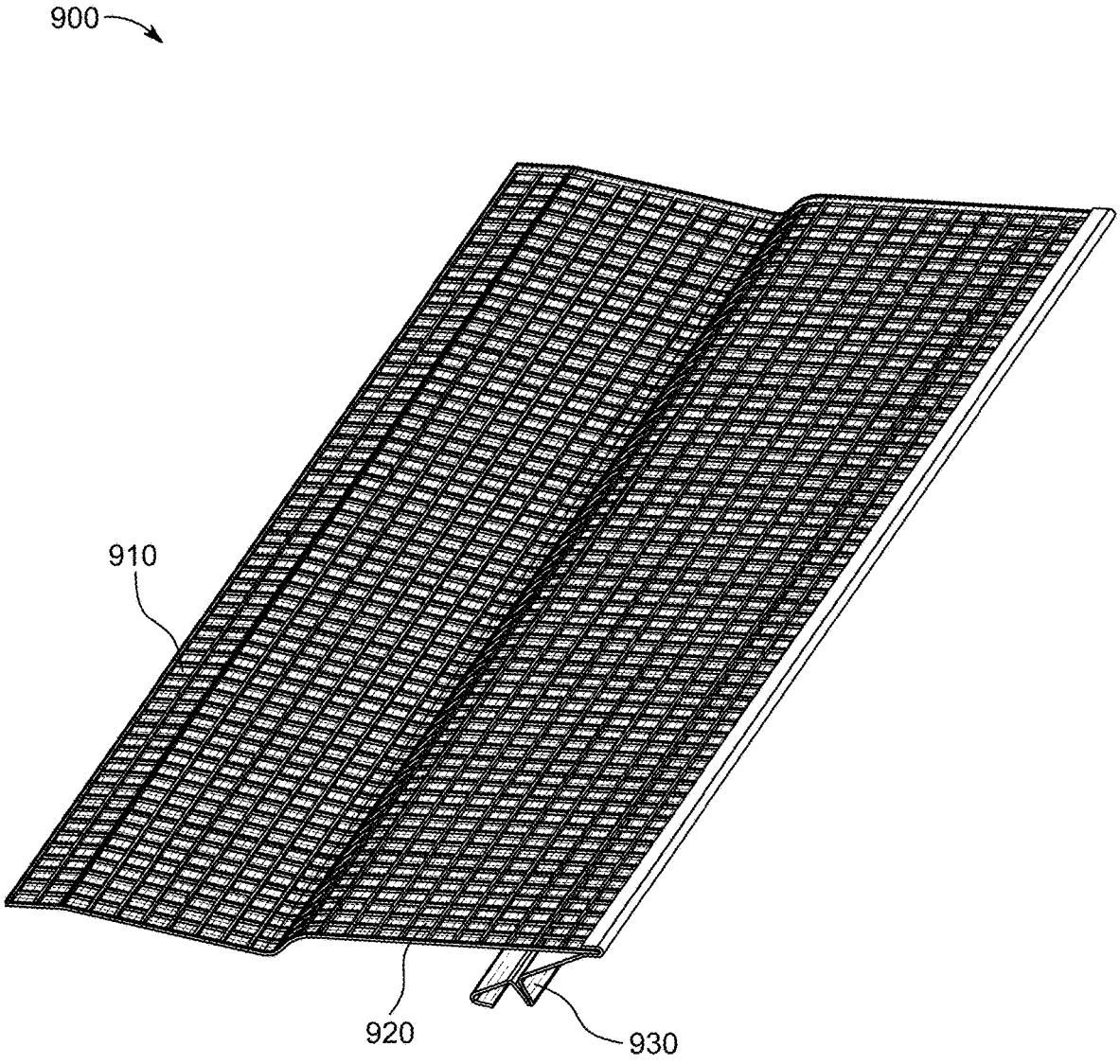
FIG. 10 schematically illustrates a screen and adapter for use with a gutter guard system.

In another example illustrated in FIG. 10, a screen 900 includes a flat area 910 positioned proximate to the rear receiver and an upwardly angled area 920 positioned proximate to the front receiver. Attached to the front edge of the screen 900 is an adapter 930 that connects that front edge of the screen 900 to the front receiver. The upwardly angled area 920 causes rainwater flowing across the screen 900 to slow and providing additional time for the rainwater to pass through the screen 900 and into the rain gutter.

We claim:

1. A gutter guard system comprising:

a main body, the main body comprising:

a front receiver arranged to engage with the front edge of a rain gutter when the gutter guard system is installed onto the rain gutter;

a rear receiver; and a water management section connecting the front receive to the rear receiver, the water management section includes a plurality of channels, wherein:

each of the plurality of channels includes a plurality of slots;

the plurality of channels includes at least one shallow channel; and the plurality of channels includes a plurality of deep channels, wherein between any two adjacent and successively arranged deep channels is disposed one of the at least one shallow channel, such that the deep channels and the shallow channels are arranged in a successive alternating fashion in the water management section; and a screen spanning the water management section and secured on a first end directly or indirectly to the front receiver and secured on a second and opposite end directly or indirectly to the rear receiver.

2. The gutter guard system of claim 1, wherein each deep channel includes a pair of angled side walls and the rounded bottom.

3. The gutter guard system of claim 2, wherein each slot of the deep channel spans the angled side walls and the rounded bottom.

4. The gutter guard system of claim 1, wherein each shallow channel includes a pair of straight walls and a flat bottom.

5. The gutter guard system of claim 4, wherein each slot of the shallow channel is formed in the flat bottom.

6. The gutter guard system of claim 1, wherein the plurality of channels includes two shallow channels and three deep channels, with a first deep channel positioned proximate to the front receiver, a first shallow channel positioned proximate to the first deep channel, a second deep channel positioned proximate to the first shallow channel, a second shallow channel positioned proximate to the second deep channel, and a third deep channel positioned proximate to the second shallow channel and the rear receiver.

7. The gutter guard system of claim 6, wherein the first shallow channel is generally the same size and dimensions as the second shallow channel.

8. The gutter guard system of claim 6, wherein the third deep channel is larger than the second deep channel and the second deep channel is larger than the first deep channel.

9. The gutter guard system of claim 8, wherein when the gutter system is installed, the bottom surfaces of the first deep channel, second deep channel, and third deep channel are all generally aligned along a horizontal plane.

10. The gutter guard system of claim 6, wherein the slots of at least one shallow channel are laterally staggered with respect to the slots of at least one deep channel.

11. The gutter guard system of claim 1, wherein the screen is directly secured to the front receiver.

12. The gutter guard system of claim 1, wherein the screen includes a rounded section running longitudinally along the length of the screen.

13. The gutter guard system of claim 1, further comprising an adapter, and wherein the screen includes a first section, a second section.

14. The gutter guard system of claim 13, wherein the first section of the screen is generally flat and parallel to the main body and the second section extends upward at an angle relative to the main body.

15. The gutter guard system of claim 14, wherein the adapter couples an edge of the second section of the screen to the front receiver.

16. The gutter guard system of claim 1, wherein the plurality of channels includes three shallow channels and four deep channels, with a first deep channel positioned proximate to the front receiver, a first shallow channel positioned proximate to the first deep channel, a second deep channel positioned proximate to the first shallow channel, a second shallow channel positioned proximate to the second deep channel, a third deep channel positioned proximate to the second shallow channel; the third shallow channel is positioned proximate to the third deep channel; and the fourth deep channel is positioned proximate to the third shallow channel and the rear receiver.

17. The gutter guard system of claim 16, wherein the first shallow channel, second shallow channel, and third shallow channel are generally the same size and dimensions.

18. The gutter guard system of claim 6, wherein the fourth deep channel is larger than the third deep channel, the third deep channel is larger than the second deep channel, and the second deep channel is larger than the first deep channel.

19. The gutter guard system of claim 2, wherein;

each side wall extends from the rounded bottom at an obtuse angle.

20. The gutter guard system of claim 19, wherein each slot of the deep channel spans the side walls and the rounded bottom.

* * * * *